United States Patent [19]

Bechem

[11] 4,045,088

[45] Aug. 30, 1977

[54] OSCILLATING DISK THIN SEAM MINING MACHINE WITH STEERING

[75] Inventor: Karl-Günther Bechem, Hagen-Berchum, Germany

[73] Assignees: Hannelore Bechem; Ingrid Binnewies, both of Hagen, Germany

[21] Appl. No.: 676,420

[22] Filed: Apr. 13, 1976

[30] Foreign Application Priority Data

| | | |
|---|---|---|
| Apr. 17, 1975 | South Africa | 75/2446 |
| Sept. 29, 1975 | South Africa | 75/6187 |
| Sept. 29, 1975 | South Africa | 75/6189 |

[51] Int. Cl.[2] ..... E21C 27/24

[52] U.S. Cl. ..... 299/31; 175/61; 299/11; 299/86

[58] Field of Search ..... 299/11, 31; 175/91, 175/94, 319, 61

[56] References Cited

U.S. PATENT DOCUMENTS

| | | | |
|---|---|---|---|
| 2,840,271 | 10/1974 | Sugden | 299/31 |
| 3,647,263 | 3/1972 | Lauber et al. | 299/31 |
| 3,647,264 | 3/1972 | Lauber | 299/31 |
| 3,663,054 | 5/1972 | Dubois | 299/31 |

FOREIGN PATENT DOCUMENTS

| | | | |
|---|---|---|---|
| 2,034,210 | 6/1970 | Germany | 299/31 |
| 2,064,617 | 7/1972 | Germany | 299/11 |

*Primary Examiner*—Ernest R. Purser

*Attorney, Agent, or Firm*—Price, Heneveld, Huizenga & Cooper

[57] ABSTRACT

The specification describes a mining machine, in particular slot drilling machine for mining of minerals, especially ores of non-ferrous metals from narrow layers of reefs in hard rock, comprising at least one drilling head pivotable about a vertical pivoting axis for arcuate drilling of a slot cavity and a carrier comprising a front part and a rear part joined by thrust cylinders and hydraulic props supportable against the upper and lower slot cavity walls, characterized in the drilling head having at least one oscillation disc segment armed with at least two or preferrably more drilling tools and provided with at least one operation cylinder engaging eccentrically to the disc segment and this oscillation disc segment being supported oscillatingly in horizontal position about the vertical pivoting axis in the front part of the carrier.

14 Claims, 3 Drawing Figures

OSCILLATING DISK THIN SEAM MINING MACHINE WITH STEERING

Figure 1:
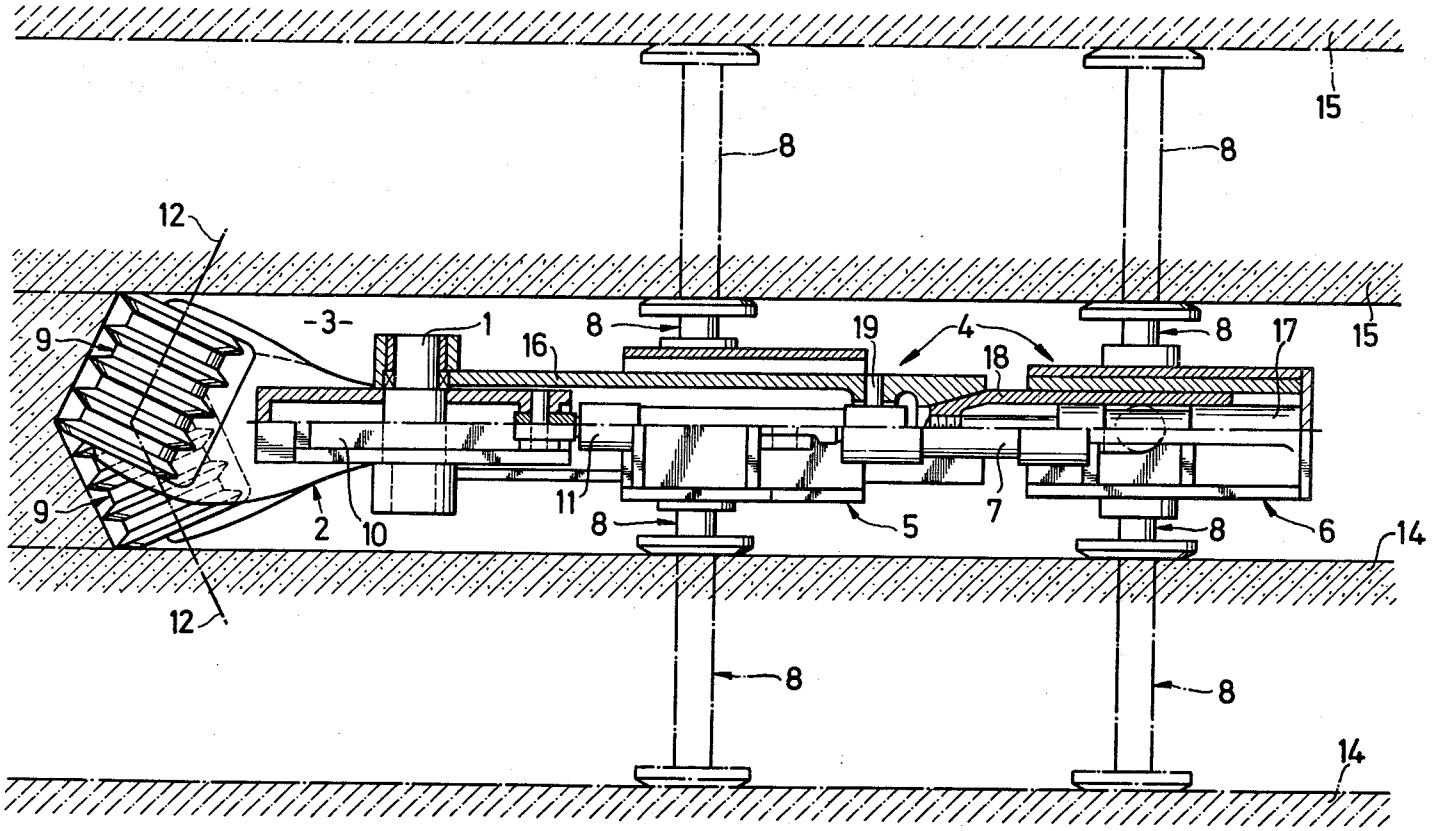

The invention relates to a mining machine and a method for mining of minerals, in particular of ores of non-ferrous metals, of thin bands of reef layers in hard rock.

The mining of minerals from bands of reef layers, the thickness of which is substantially less than the required working cavity, provides problems, in particular if the layers are in hand rock. Such layers often are referred to as reefs. It already has been attempted to excavate layers selectively, in that slots are cut along the upper and lower border surface of the relevant ore layer. The ore layer then can be broken out in the exposed regions.

Subsequently the slot space which is formed thereby, is widened to a normal working height. Thereby a working cavity is formed, which is to be supported. The working cavity support generally is a wooden structure, in exceptional cases a steel construction, and in any case in the known manner this is extremely expensive regarding material, time and labour. Here the invention intends to provide a relief.

Tunnel drilling machines also are known with at least one drilling head pivotable about a horizontal pivoting axis for arcuate drilling out of a tunnel space and with a carriage with front part and rear part joined by thrust cylinders and being supportable against the slot space walls by means of hydraulic props. Such tunnel drilling machines are not practical for use as mining machines, if the mining of minerals has to take place from thin layers. In fact, the known tunnel drilling machines are relatively high and wide and are almost unsuitable for excavating only narrow bands of reef layers of minerals in hard rock. In any case, the application for such purposes is uneconomic.

Another method of excavating thin layers of ore, known under the name of 'slot drilling' is carried out by drilling a row of parallel, cylindrical holes into the reef, leaving a narrow bridge of ore untouched between two adjacent holes as support for the overlaying rock. In this way it is not possible to excavate the ore layer completely.

The invention has as object to provide a mining machine, in particular a slot drilling machine, which simplifies the mining of minerals, in particular of ores of non-ferrous metals, from bands of reef layers and for this purpose is provided as a particularly compact, flat and adaptable construction with great manoeuvrability and relatively low weight.

According to the invention, a mining machine, in particular a slot drilling machine is proposed with at least one drilling head pivotable about a vertical pivoting axis for arcuate drilling of a slot cavity and with a carriage comprising a front part and a rear part joined by thrust cylinders and hydraulic props supportable against the slot cavity wall, the bore head has at least one oscillation disc segment armed with one or more drilling tools with at least one operation cylinder engaging eccentrically to it and this oscillation disc segment is supported oscillatingly in horizontal position about the vertical pivoting axis.

In this manner a mechanically relatively simple design of a drilling head is achieved, which is characterized by extreme freedom of movement and which can cut into the full reef as well as work continuously along a stoping face. Simultaneously the drilling head can be extremely flat, because the drilling tools are carried by a single oscillating disc segment in such a way, that they cut a slot, which is slightly higher than the machine-body. Further there exists the possibility that several oscillation disc segments are arranged side by side, and/or one above the other, and/or displaced to each other in travelling direction.

Further characteristics in accordance with the invention are set out hereafter. Thus the invention provides that the oscillation disc segment is fitted with conventional or vibrating roller bits as drilling tools. Roller bits are particularly suitable for drilling out or breaking out hard rock. According to a suggestion of the invention it is provided that respectively at least two roller bits are arranged displaced in height to each other and with their roller axes inclined to each other in vertical orientation with the formation of a V-shaped or circular or other shaped drilling line in vertical projection plane as well as exceeding the height of the machine-body. Consequently the total mining machine in accordance with the invention is flatter than the height of the roller bits and therefore is characterized in particular by its compact construction. It therefore is suitable for application as slot drilling machine in places where reef mineral layers of lesser thickness are to be mined from hard rock. Adaptability and extreme manoeuvrability of the slot drilling machine according to this invention, is obtained by the fact that the front part and the rear part of the carriage are formed as rockers, suspended pivotable or linked on both sides to the hydraulic props which are supported against the foot wall and hanging wall.

Consequently the carriage is supported against the foot and hanging walls by means of hydraulic props arranged on the outside, so that travelling movements are possible not only in a straight line forwards and backwards, but in addition also as an extreme movement to the right or the left of the working direction by working the thrust cylinders, while at the front either on the right or the left a hydraulic prop remains supported against the foot and hanging walls and the remaining hydraulic props are released.

In addition to a travelling movement in all directions also a turning of the mining machine on the spot through more than 180° is possible, and always work without bridge or step formations is ensured.

In the front part preferably there is guided a slide with the oscillation disc segment mounted thereto, while in the rear part at least one thrust cylinder acts against the slide. In one form of design advantageously two thrust cylinders are provided in the rear part axial-symmetrically next to each other, which are connected to the carriage in rigid manner or by way of a link-connection. In the case of a link-connection a deviation of the drilling tool from its horizontal plane in the vertical direction is obtainable and therewith an up and down movement. The thrust cylinders can be mounted in guide bushes joined to the slide. In accordance with the invention two operating cylinders are mounted on the slide axial-symmetrically next to each other and being pivotable about a vertical pivoting axis and engage diametrally to the oscillation disc segment.

According to a further embodiment of the invention it is provided that the oscillation disc segment is mounted to oscillate to and fro on a slide, which can move in a traverse. This traverse is supported on both sides by hydraulic props, which can be joined to a third hydraulic prop by means of thrust cylinders with formation of a three-point support. In this manner a particularly simple construction is obtained for the carriage, namely a frame construction with merely hydraulic props and thrust cylinders as well as operating cylinders for the drilling tools with intermediate connection of one or more oscillation disc segments. Additionally the third hydraulic prop can be joined by means of a thrust cylinder to the centre of the slide. The invention further suggests that two operating cylinders, which are joined to the slide, engage symmetrically to the oscillation disc segment. Two or more oscillation disc segments can be arranged on the slide either side by side, and/or above another and/or displaced in travelling direction.

The invention also relates to a method for mining of minerals, in particular of ores of non-ferrous metals, from narrow reef layers in hard rock by means of a mining machine in accordance with the invention, which is characterized thereby that initially the mineral containing layer is drilled out or cut out from its exposed face side on a wide front in layer height and in given depth from the rock, and thereafter the slot cavity so formed can be widened to a full working height by a similar machine and this working cavity is supported by means of support props provided between foot and hanging walls, using rock received from the working cavity in comparatively small pieces to form with the addition of a cement/water mixture concrete - support props.

A distinct from the previously known slot cutting process according to the invention the mineral containing layer to be mined is not opened first and is then broken out from between the upper and lower slots by hand, but the layer is taken out directly so that the created slot cavity can be mined mechanically and can then be widened into a working cavity without taking care of the mineral containing layer, which has been removed before.

The invention will now be described by way of example with reference to the accompanying schematic drawings.

It is shown in

Figure 2:
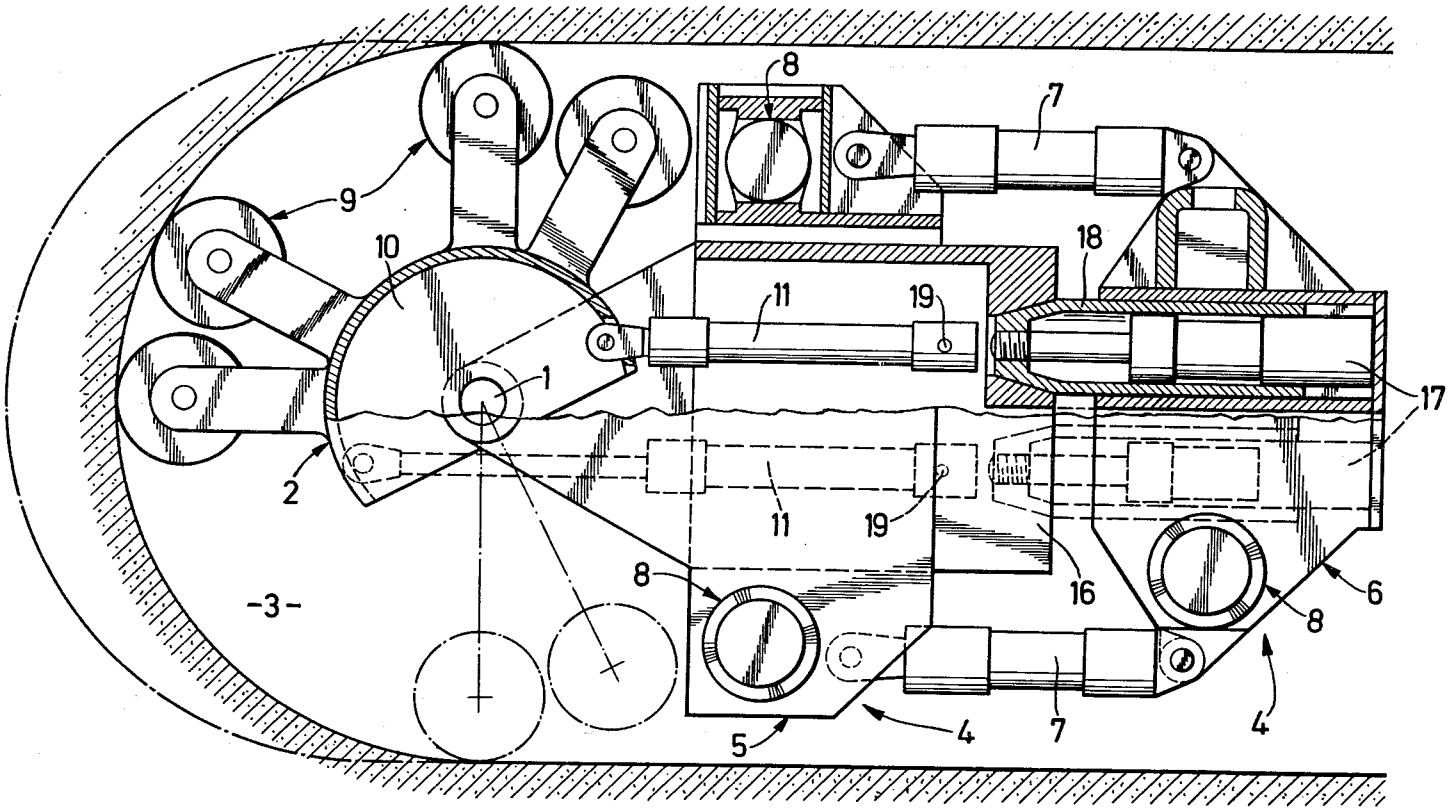

FIG. 1 in schematic repesentation a mining machine, in particular a slot drilling machine, in accordance with the invention and shown during use (in side view);

FIG. 2 the machine of FIG. 1 seen from above; and

Figure 3:
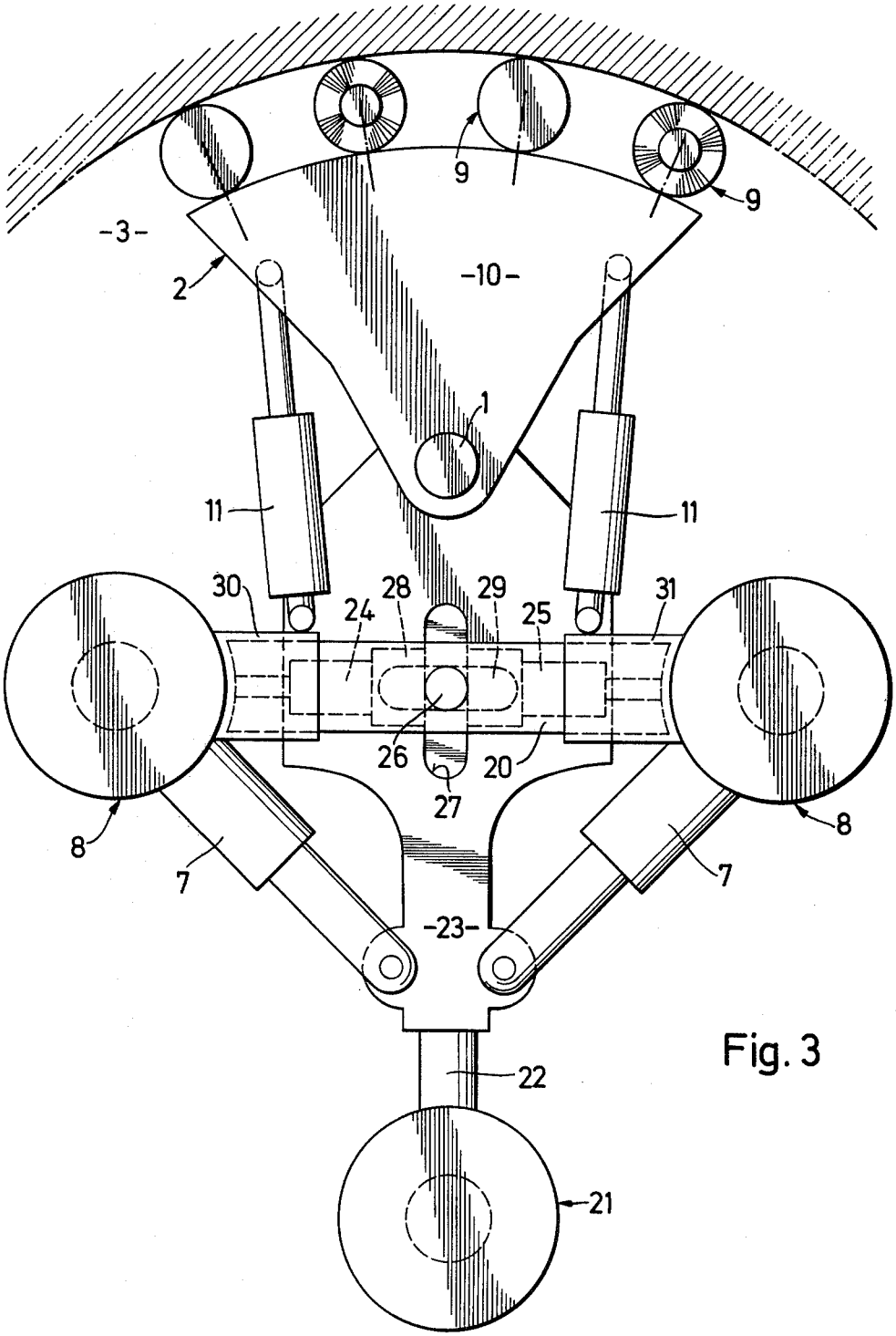

FIG. 3 a further variation of the machine according to FIG. 1 in plan view from above.

In the drawings a mining machine, in particular a slot drilling machine, is illustrated, which in its basic construction consists of a drilling head 2, which is pivotable about a vertical pivoting axis 1 and which is sued for arcuate drilling out of a slot cavity 3, further a carrier 4 comprising a front part 5 and a rear part 6 both joined by thrust cylinders 7 and hydraulic props 8 supportable against upper and lower slot cavity wall. The drilling head 2 has at least one oscillating disc segment 10 armed with at least two or preferably more drilling tools 9 and provided with at least one eccentrically engaging operation cylinder 11.

The oscillating disc segment 10 is suspended at the front part 5 of the carrier 4 to oscillate in a horizontal plan about the vertical pivoting axis 1. If the oscillation disc segment 10 is operated with only one single engaging operation cylinder 11, then this cylinder is provided as double acting cylinder. If it is ncessary to excavate over a relatively wide front, then several oscillating disc segments 10 can be arranged next to each other and staggered in travelling direction. In the shown and preferred embodiment each oscillation disc segment 10 is armed with roller bits as drilling tools 9. According to FIG. 1 two roller bits are staggered in vertical direction relatively to each other and in vertical orientation to each other at inclined roller axes 12 with the consequent formation of a V-shaped, circular or other drilling line in vertical projection plane.

The roller bits arranged in this manner thereby exceed the height of the machine-body, so that it can follow the excavation development even when mining minerals from reef layers of particularly thin thickness. The front part 5 and the rear part 6 of the carrier 4 are formed as rockers, which are suspended pivotably about a horizontal pivoting axis 13 or which are link-connected on both sides to the hydraulic props 8, which are supported against the lower or foot wall 14 and the upper or hanging wall 15. Preferably three or four hydraulic props 8 are provided in axial-symmetrical arrangement on both sides of the carrier 4, so that the slot drilling machine can move and drill not only forwardly and rearwardly, but also in an extremely arcuate manner to the right or the left. In such a case the front right or left hydraulic prop 8 is left supported against the hanging wall 15 and the foot wall 14 while the other hydraulic props 8 are released, and on operation of the thrust cylinder 7 are moved for 180° or more with the carrier 4 and the drilling head 2 about the front right or left extended hydraulic prop, which is thus supported. In the front part 5 of the carriage 4 a slide 16 is provided on which the oscillating disc segment 10 is mounted. In the rear part 6 at least one thrust cylinder 17, acting against the slide 16, is provided. Preferably two thrust 17, arranged axial-symmetrically side by side in the rear part 6, are linked to the slide 16. The thrust cylinders 17 are mounted in guide bushes 18 connected to the slide 16. On the slide 16 two operation cylinders 11 are mounted axial-symmetrically side by side so as to be pivotable about vertical pivoting axes 19 and engage diametrally with the oscillation disc segment 10. In this case the operation cylinders 11 can be provided as single acting cylinders.

According to a variation of the mining or slot drilling machine as shown in FIG. 3, and in particularly regarding the carrier, it is provided that the oscillation disc segment 10 is mounted on a slide 23 to oscillate to and fro. The traverse 20 is supported on both sides by the hydraulic props 8, which are connected to a third hydraulic prop 21 by means of the thrust cylinder 7 with the formation of a three-point support. The third hydraulic prop 21 is to be connected additionally to the rear end of the slide 23 by means of a thrust cylinder 22. In this version a continuous operation of the machine is possible, that means, interruptions are only required for switching the hydraulics.

Two operating cylinders 11, which are connected to the slide 23, engage symmetrically on both sides on the oscillating disc segment 10. The thrust and operation cylinders 7, 11, 22 are mounted so as to be link-connected. In order to simplify the presentation of the mining or slot drilling machine, the connection of the drilling tools 9 to the oscillating disc segment or segments 10 as well as the hydraulic installation are not shown. In the construction of FIG. 3 impact tools 9 are used.

Machines according to the invention can be used to widen the slot by lengthening the hydraulic props on the lower or upper side. But this is also possible by moving the machine-body upwards or downwards within the maximum stroke of the prop-cylinders.

This can be particularily important if one has to reckon with a movement of the rock face due to pressure in the rock. In this case one would initially drill a wider slot, if in case of emergency the machine has to be retracted, although the slot is narrowing due to rock pressure. (See FIG. 1, pos. 14, 15).

According to preferred embodiment of the invention the mining machine in accordance with the invention is characterized by the fact, that it can excavate by alternating cooperation with the thrust cylinders 7 or 22 and the hydraulic props 8 or 21 in each desired working direction and by turning on the spot about a vertical rotational axis through more than 180°, and also by working without resulting bridge or step formations. The drilling tools 9, in accordance with the invention, are roller, impact or cutting drilling tools, in particular formed as conventional or impact roller bits, impact hammers, beams or jet cutters, or any other suitable cutters. By means of these drilling tools 9 the mining machine can be fitted individually or in combination with different cutter types.

Advancing of the machine as represented in FIG. 3 takes place as described hereinafter.

The three hydraulic props 8, 8 and 21 are supported against the lower or foot wall and the upper or hanging wall. The disc segment head 10 with the tools 9 mounted thereto can be oscillated to one side and to the other, respectively by means of correspondingly engaging operating cylinders 11. With respect to the specific embodiment disclosed those tools 9 are impact tools because roller bits as drilling tools would demand a slightly differing construction permitting the disc segment 10 to be moved in a similar way as disclosed in connection with FIG. 2.

The slide 23 is continuously pressed ahead by the operating cylinder 22 which is supporting against the hydraulic prop 21 wherein the thrust cylinders 7 alternatively can be set pressureless or can assist such an advancing movement by corresponding pressure admission. Slide 23 then moves against the traverse 20 guided by a pin or stud 26 which in turn slides in a slot 27 of slide 23.

In another modified embodiment traverse 20 further comprises a block-like sliding element 28 slidably mounted for sliding movement within traverse 20 by means of alternatively engaging operating cylinders 24 and 25. During this sliding movement slide 23 is engaged and taken along so that slide 23 can be pivoted around the axis of the hydraulic prop 21 which in turn is pivotally mounted for pivotal movement around her axis as well as are the hydraulic props 8. Further, this embodiment is giving permission to traverse 20 to be guided by socket formed or bushing like adjoint pieces 30 and 31 mounted to the hydraulic props 8 whereby the corresponding hydraulic props can be moved aside when one of the hydraulic props 8 has been released and when the corresponding thrust cylinder 7 has been set pressureless.

The machine according to this invention, can be installed completely or partly in a shield, a box or the like, in which case the thrust for the drilling tools can be excerted from behind over the shield, the box or the like.

In this embodiment the shield, the box or the like covers the drilling head to an appreciable extent and serves simultaneously as a guide, so that additional clamping devices can be omitted.

The widening of the slot can be carried out not only in the manner described above, but also by the addition of special widening tools, which can be swung out, pushed out or the like and, for emergency cases, may be arranged to drill in rearward direction.

I claim:

1. A mining machine having a drilling head and a carrier, means pivotally mounting said head to the forward end of said carrier; fluid operated means for arcuately reciprocating said drilling head about said pivot means; said carrier having a first portion and a second portion, said portions being laterally pivotable with respect to each other about a veratical axis which is capable of limited travel both lengthwise and laterally of said machine; a pair of laterally spaced hydraulic props mounted on one of said portions, one of said props being on each side of the longitudinal centerline of said machine, each of said props having extensible legs extending both above and below said carrier to provide floor and roof engagement; at least one hydraulic prop mounted on the second of said portions and having extensible legs extending both above and below said carrier to provide floor and roof engagement; a pair of extensible and retractable cylinders interconnecting said first and second portions, said cylinders being independently operable to pivot said portions with respect to each other and about one of said props by extension or retraction of said cylinders to enable said machine to execute a turn of 90° substantially about its midpoint.

2. A mining machine as described in claim 1 wherein said hydraulic prop mounted on said second portion independently of said cylinders is movable longitudinally of said machine with respect to said first section.

3. A mining machine as described in claim 1 wherein said carrier is selectively movable lengthwise of said props to adjust the vertical position thereof with respect to the floor and roof surfaces.

4. A mining machine as described in claim 1 wherein each of the props extending from said carrier toward the mine floor are extensible and retractable independently of the props extending toward the mine roof.

5. A mining machine as described in claim 1 wherein said first and second portions are offset with respect to each other lengthwise of said machine.

6. A mining machine as described in claim 5 wherein means are provided for urging said front and rear portions apart for biasing said drilling head into the rock ahead of said machine.

7. A mining machine as described in claim 1 wherein said first and second portions are vertically superimposed one above the other.

8. A mining machine as described in claim 7 wherein said first portion is a laterally extending beam and said pair of props are mounted thereon, one adjacent each end; said second portion being a longitudinally extending member; a pivot pin interconnecting said first and second portions substantially at their geometric centers; a slot-like opening in said beam receiving said pivot pin for permitting lateral displacement of said beam with respect to said pin; a longitudinal slot in said second portion receiving said pin for permitting longitudinal displacement of said second portion with respect to said pin.

9. A mining machine as described in claim 7 wherein said first portion is a laterally extending beam and said pair of props are mounted thereon, one adjacent each end; said second portion being a longitudinally extending member; a pivot pin interconnecting said first and second portions substantially at their geometric centers; said first portion being laterally movable with respect to said pin and said second portion being longitudinally movable with respect to said pin.

10. A mining machine as described in claim 9 wherein a fluid operated piston means in secured to said first portion and acts lengthwise thereof to shift said first portion laterally with respect to said second portion.

11. A mining machine as described in claim 9 wherein a pair of fluid operated piston means are secured to said first portion, one on each side of said pin and acts lengthwise of said first portion to shift said first portion laterally with respect to said second portion.

12. A mining machine for mining ores of non-ferrous metals from narrow reefs in hard rock, said machine having a drilling head and a carrier; said carrier having a front portion and a rear portion, means pivotally mounting said head to said front portion; hydraulic means for arcuately reciprocating said drilling head about said pivot means; a pair of laterally spaced independently operable, fluid operated extensible and retractable cylinders interconnecting said front and rear portions and providing the only hinge connection between said portions; a pair of fluid operated props on said front portion, each of said props having extensible and retractable legs projecting both above and below said front portion to provide floor and roof engagement; said leg means being laterally spaced, one on each side of the longitudinal centerline of said machine; at least one fluid operated prop on said rear portion offset laterally to one side of said longitudinal centerline, said portions with respect to each other being pivotal in incremental steps at least 90° to either side about one of said props by selective extension and retraction of said cylinders and of said props whereby said machine may be made to execute a turn of 90° about its approximate midpoint.

13. A mining machine as described in claim 12 wherein said head mounting pivot means is on said longitudinal centerline of said machine and said head has a plurality of drilling tools, said head in combination with said forward portion having an arc of lateral pivotal movement such that said tools have a cutting arc in excess of 180°.

14. A mining machine as described in claim 12 wherein said cylinders are adjacent the lateral side edges of said machine and said prop means on said forward portion are substantially aligned with said cylinders, one on each side, said prop means on said rear portion being offset laterally inwardly of said cylinders whereby actuation of said cylinders can result in rotational movement of said rear portion about one of said props on said rear portion.

* * * * *